US007664447B2

(12) United States Patent
Yagi et al.

(10) Patent No.: US 7,664,447 B2
(45) Date of Patent: Feb. 16, 2010

(54) FIXING DEVICE AND IMAGE FORMING APPARATUS

(75) Inventors: Masahiro Yagi, Ibaraki (JP); Yoshihiro Fukuhata, Hyogo (JP); Shigeru Obata, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/832,869

(22) Filed: Aug. 2, 2007

(65) Prior Publication Data

US 2008/0031664 A1 Feb. 7, 2008

(30) Foreign Application Priority Data

Aug. 3, 2006 (JP) ..... 2006-212374

(51) Int. Cl.
*G03G 15/20* (2006.01)

(52) U.S. Cl. ..... 399/328; 399/329; 399/331; 399/333

(58) Field of Classification Search ..... 399/320, 399/328, 329, 331; 219/216, 619
See application file for complete search history.

(56) References Cited

U.S. PATENT DOCUMENTS 4,627,813 A * 12/1986 Sasaki ..... 432/60
2004/0151515 A1* 8/2004 Nakayama ..... 399/67
2005/0025537 A1* 2/2005 Echigo et al. ..... 399/329
2005/0078990 A1* 4/2005 Shiraishi ..... 399/329
2007/0140752 A1 6/2007 Yamamoto et al.
2007/0223976 A1 9/2007 Yagi et al.

FOREIGN PATENT DOCUMENTS

| | | |
|---|---|---|
| JP | 63-36283 | 2/1988 |
| JP | 3298354 | 4/2002 |
| JP | 2005-164721 | 6/2005 |
| JP | 3829695 | 7/2006 |

OTHER PUBLICATIONS

U.S. Appl. No. 11/832,869, filed Aug. 2, 2007, Yagi, et al.

* cited by examiner

*Primary Examiner*—David M Gray
*Assistant Examiner*—G. M. Hyder
(74) *Attorney, Agent, or Firm*—Oblon, Spivak, McClelland, Maier & Neustadt, L.L.P.

(57) ABSTRACT

A fixing device includes a fixing member of which surface is deformable, a heating unit that heats the fixing member, a pressurizing unit having an endless member and a pressurizing member. The pressurizing member includes an elastic layer and presses the endless member against the fixing member to bring the endless member into pressure contact with the fixing member. The elastic layer has an apparent hardness (ASKER-C) which is larger than that at a point where an apparent hardness starts to change rapidly with respect to a rubber thickness in a load application direction.

27 Claims, 6 Drawing Sheets

FIXING DEVICE AND IMAGE FORMING APPARATUS

CROSS-REFERENCE TO RELATED APPLICATIONS

The present application claims priority to and incorporates by reference the entire contents of Japanese priority document, 2006-212374 filed in Japan on Aug. 3, 2006.

BACKGROUND OF THE INVENTION

1. Field of the Invention

The present invention relates to a fixing device of an image forming apparatus. More particularly, the present invention relates to a fixing device that includes an endless member that is brought into pressure contact with a fixing member.

2. Description of the Related Art

A heat fixing device is used in an image forming apparatus such as a copier, a printer, or a facsimile. A typical heat fixing device fixes an unfixed toner image onto a paper sheet by use of heat and pressure. For example, Japanese Patent No. 3298354 discloses a conventional heat fixing device that employs a belt-nip system. In such a belt-nip system, a fixing member, such as a fixing roller, is brought into pressure contact with an endless pressure-contact member, such as an endless belt, to form a nip portion between the fixing member and the endless pressure-contact member. A paper sheet with an unfixed toner image thereon is passed through the nip portion. As a result, the paper sheet is heated and pressurized, so that the unfixed toner image is fixed onto the paper sheet.

The conventional heat-fixing device includes a heating-fixing roller having an elastically deformable surface that is subjected to local elastic deformation at the exit (nip exit) of a nip portion. Such local deformation at the nip exit, however, leads to variations in the surface speed of the heating-fixing roller (see FIG. 4 of Japanese Patent No. 3298354). The variations in the surface speed of the heating-fixing roller leads to shifting of writing position of an image, which in turn leads to degradation in image quality.

In addition, a hard member is pressed against an elastic layer of the heating-fixing roller to locally cause deformation of the elastic layer, so that a nip portion having a small curvature is formed. This configuration, however, imposes a large load on the paper sheet, which disadvantageously leads to damage to the recoding medium and/or curling of the recoding medium.

SUMMARY OF THE INVENTION

It is an object of the present invention to at least partially solve the problems in the conventional technology.

According to an aspect of the present invention, there is provided a fixing device including a fixing member with a deformable surface; a heating unit configured to heat the fixing member; a pressurizing unit that includes an endless member and a pressurizing member, the pressurizing member including an elastic layer that presses the endless member against the fixing member to bring the endless member into pressure contact with the fixing member. A recording medium carrying an unfixed toner image passes through a nip portion formed between the fixing member and the endless member, so that the unfixed toner image is fixed on the recording medium by heat and pressure. The elastic layer has an apparent hardness (ASKER-C) which is larger than that at a point where an apparent hardness starts to change rapidly with respect to a rubber thickness in a load application direction.

According to an aspect of the present invention, there is provided an image forming apparatus including a fixing member with a deformable surface; a heating unit configured to heat the fixing member; a pressurizing unit that includes an endless member and a pressurizing member, the pressurizing member including an elastic layer that presses the endless member against the fixing member to bring the endless member into pressure contact with the fixing member. A recording medium carrying an unfixed toner image passes through a nip portion formed between the fixing member and the endless member, so that the unfixed toner image is fixed on the recording medium by heat and pressure. The elastic layer has an apparent hardness (ASKER-C) which is larger than that at a point where an apparent hardness starts to change rapidly with respect to a rubber thickness in a load application direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
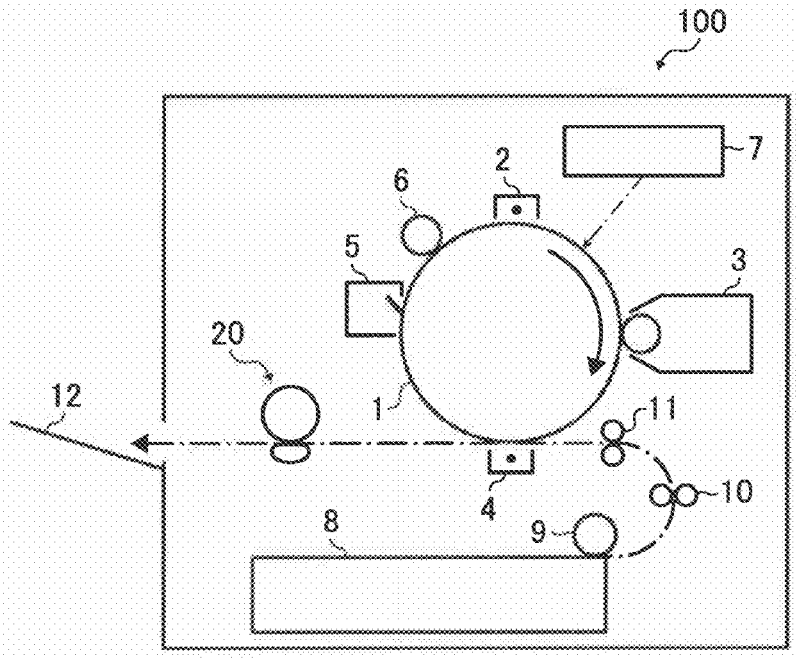
FIG. 1 is a schematic diagram of an image forming apparatus according to a first embodiment of the present invention.

FIG. 1 is a schematic diagram of a laser printer 100 that is an example of an image forming apparatus according to a first embodiment of the present invention. The laser printer 100 includes a fixing device 20. The laser printer 100 includes a photoreceptor drum 1 as an image carrier. A charging unit 2, a developing unit 3, a transfer unit 4, a cleaning unit 5, a removing unit 6, and the like are arranged around the photoreceptor drum 1. A laser writing unit 7 is located above the exposure position on the photoreceptor drum 1 between the charging unit 2 and the developing unit 3, and the photoreceptor drum 1 is irradiated with a writing beam from the laser writing unit 7 at the exposure position.

A sheet feeding cassette 8 is provided at a lower portion of the laser printer 100. A sheet feeding roller 9, a conveying roller pair 10, a resist roller pair 11, and the like are arranged for feeding paper sheets in a nip portion between the photoreceptor drum 1 and the transfer unit 4. A fixing device 20 is arranged downstream of a transfer portion where the photoreceptor drum 1 and the transfer unit 4 oppose each other.

When forming an image, a driving unit (not shown) rotationally drives the photoreceptor drum 1 in the clockwise direction shown by an arch-shaped arrow. The surface of the photoreceptor drum 1 is uniformly electrically charged by the charging unit 2 to a predetermined polarity. A laser diode (LD) (not shown) of the laser writing unit 7 is driven based on image data, which is sent from a host machine such as a personal computer, to emit a laser beam. The surface of the photoreceptor drum 1 is irradiated with the laser beam so that an electrostatic latent image is formed on the surface. The developing unit 3 applies toner to the electrostatic latent image, so that the electrostatic latent image is visualized as a toner image on the surface of the photoreceptor drum 1.

Meanwhile, a paper sheet is fed from the sheet feeding cassette 8 by the sheet feeding roller 9, and is conveyed by the conveying roller pair 10. The paper sheet is once stopped by the resist roller pair 11, and thereafter is conveyed while being synchronized with the visible toner image. The toner image is transferred to the paper sheet at the transfer portion at which the photoreceptor drum 1 and the transfer unit 4 oppose each other. When the paper sheet with the toner image passes through the fixing device 20, the toner image is fixed onto the paper sheet by heat and pressure. The paper sheet with the toner image fixed thereon is discharged onto a sheet discharge tray 12.

Once the toner image is transferred to the paper sheet, the cleaning unit 5 cleans material, such as residual toner, adhering to the surface of the photoreceptor drum 1. The removing unit 6 removes the residual static electricity residing on the surface of the photoreceptor drum 1. In this manner, one cycle of the operations for forming an image is completed.

Figure 2:
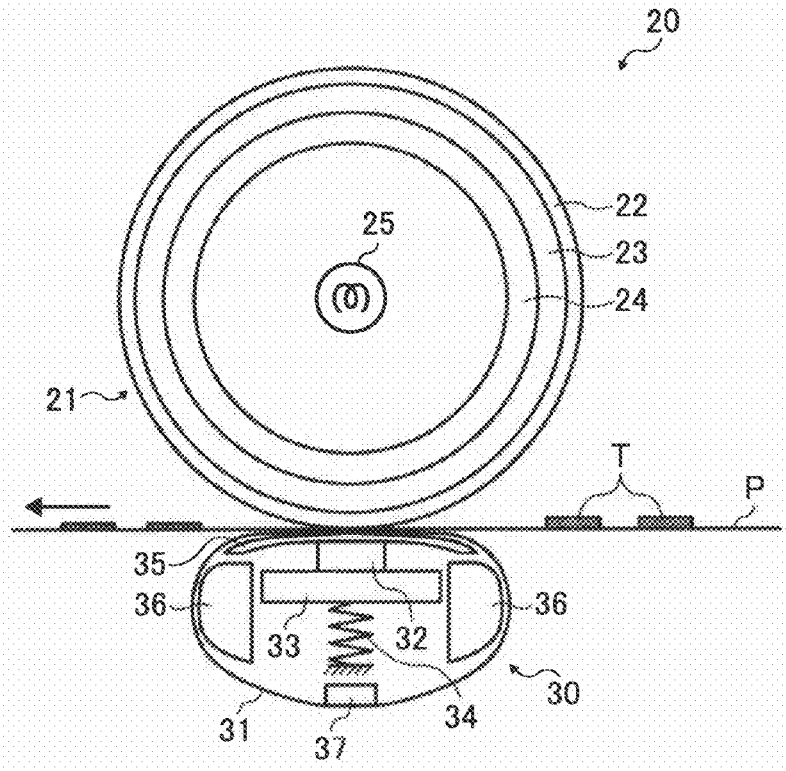
FIG. 2 is a schematic diagram of a fixing device shown in FIG. 1.

FIG. 2 is a schematic diagram of a relevant portion of the fixing device 20. The fixing device 20 includes a heating-fixing roller 21 as a fixing member that is directly in contact with a paper sheet. The heating-fixing roller 21 includes a surface-covering layer 22, an elastic layer 23, and a core 24. A fixing heater 25 as a heat source is arranged at substantially the center of the heating-fixing roller 21. The fixing heater 25 heats the heating-fixing roller 21 from inside. The heating-fixing roller 21 is rotationally driven in the clockwise direction in FIG. 2 by a driving unit (not shown). A pressurizing unit 30 is in pressure contact with the heating-fixing roller 21. A paper sheet P with an unfixed toner image T thereon passes through a nip portion between the heating-fixing roller 21 and the pressurizing unit 30. The heating-fixing roller 21 and the pressurizing unit 30 apply heat and pressure to the unfixed toner image T on the paper sheet P. As a result of application of pressure and heat, the unfixed image T is fixed onto the paper sheet P.

The surface-covering layer 22 can be made from, for example, PFA (Tetrafluoroethylene perfluoroalkoxy vinyl ether copolymer). The surface-covering layer 22 inhibits the unfixed toner from adhering to the surface of the heating-fixing roller 21. The elastic layer 23 can be made from, for example, silicon rubber or fluoro rubber. If the elastic layer 23 is made from silicon rubber, it is preferable that the elastic layer 23 be coated with, for example, a fluorine layer or the like to improve swelling resistance.

The pressurizing unit 30 includes a pressure-contact member 31, which is an endless member, that is directly in contact with the heating-fixing roller 21 (fixing member), or that is indirectly in contact with the heating-fixing roller 21 via the paper sheet P. The pressurizing unit 30 also includes, inside the loop of the pressure-contact member 31, a pressurizing member 32, a supporting member 33 that supports the pressurizing member 32, a pressing spring 34 as a biasing unit that presses the pressurizing member 32 and the supporting member 33 against the heating-fixing roller 21, a friction-reducing member 35 that is arranged between the pressure-contact member 31 and the pressurizing member 32 and reduces friction therebetween, two guiding members 36 that guide the pressure-contact member 31 thereby defining a conveying path of the pressure-contact member 31, and a lubricant-supplying member 37 that supplies a lubricant to an inner surface of the pressure-contact member 31 for further reducing friction between the pressure-contact member 31 and the pressurizing member 32.

The lubricant can be any lubricant, however, a lubricant that contains silicon oil and/or fluorine oil is preferable. The pressure-contact member 31 can be made from PFA and/or polyimide. The pressurizing member 32 can be any member having a substantially a flat surface. The pressurizing member 32 includes a rubber layer (not shown) formed of silicon rubber and/or fluoro rubber, and layers of some other material. In another embodiment, the pressurizing member 32 can be made from rubber alone. The pressurizing member 32 corresponds to a "pressurizing member" in the claims.

Apparent hardness (ASKER-C) with respect to rubber thickness in a direction in which a load is applied to the pressurizing member 32 (hereinafter, "load application direction") is explained with reference to FIG. 3. Hardness of a rubber alone is measured to comply with JIS-A Standard. The horizontal axis shown in FIG. 3 represents the rubber thickness (millimeter) in the load application direction, and the vertical axis represents the apparent hardness (ASKER-C).

Figure 3:
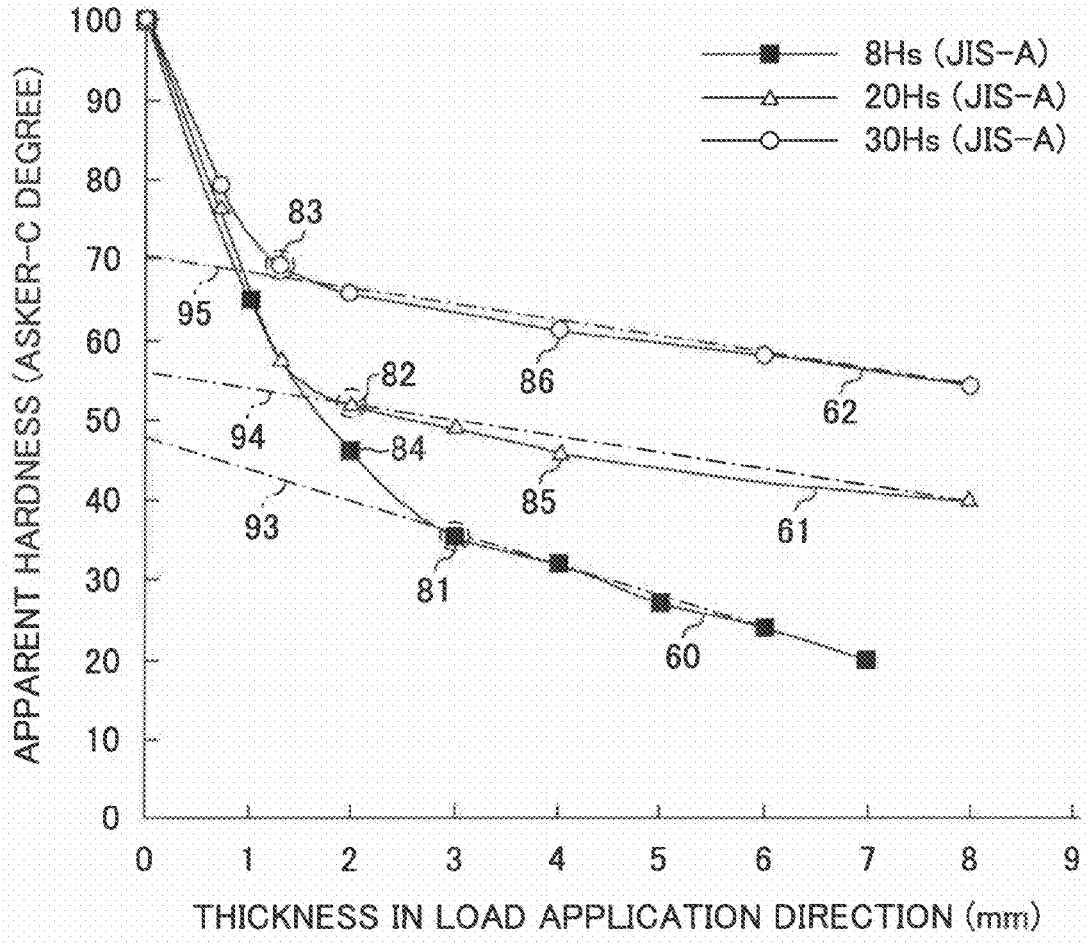
FIG. 3 is a graph for explaining apparent hardness (ASKER-C) with respect to rubber thickness in a load application direction.

A curved line 60 shown in FIG. 3 represents apparent hardness of a rubber having a hardness of 8 Hs (JIS-A). A curved line 61 represents apparent hardness of a rubber having a hardness of 20 Hs (JIS-A). A curved line 62 represents apparent hardness of a rubber having a hardness of 30 Hs (JIS-A).

The straight lines 93, 94, and 95 are approximate straight lines obtained by performing a first order approximation to a hardness (JIS-A) measured with the ASKER-C type hardness meter in a range linearly proportional to the rubber thickness. Specifically, the straight lines 93, 94, and 95 are respectively approximate straight lines of a hardness of 8 Hs (JIS-A), a hardness of 20 Hs (JIS-A), and a hardness of 30 Hs (JIS-A).

In the case of the rubber having a hardness of 8 Hs (JIS-A), the curved line 60 starts to deviate from the straight line 93 at a point 81 at which the rubber thickness is about 3 mm. In the case of the rubber having a hardness of 20 Hs (JIS-A), the curved line 61 starts to deviate from the straight line 94 at a point 82 at which the rubber thickness is about 2 mm. In the case of the rubber having a hardness of 30 Hs (JIS-A), the curved line 62 starts to deviate from the straight line 95 at a point 83 at which the rubber thickness is about 1.3 mm.

In this manner, the apparent hardness of rubber having a small thickness in the load application direction is larger than the actual hardness (JIS-A). As the hardness (JIS-A) increases, the point at which a curved line starts to deviate from a straight line is shifted to the upper left (i.e., to the direction to which the apparent hardness increases, and the rubber thickness in the load application direction decreases) on the graph in FIG. 3.

A test point 84 represents the apparent hardness of a rubber with a hardness of 8 Hs (JIS-A) and a thickness in the load application direction of 2 mm, under the conditions the later described releasability tests are performed.

A test point 85 represents the apparent hardness of a rubber with a hardness of 20 Hs (JIS-A) and a rubber thickness in the load application direction of 4 mm, under the conditions the later described releasability test is performed.

A test point 86 represents the apparent hardness of a rubber with a hardness of 30 Hs (JIS-A) and a rubber thickness in the load application direction of 4 mm, under the conditions the later described releasability test is performed.

Figure 4:
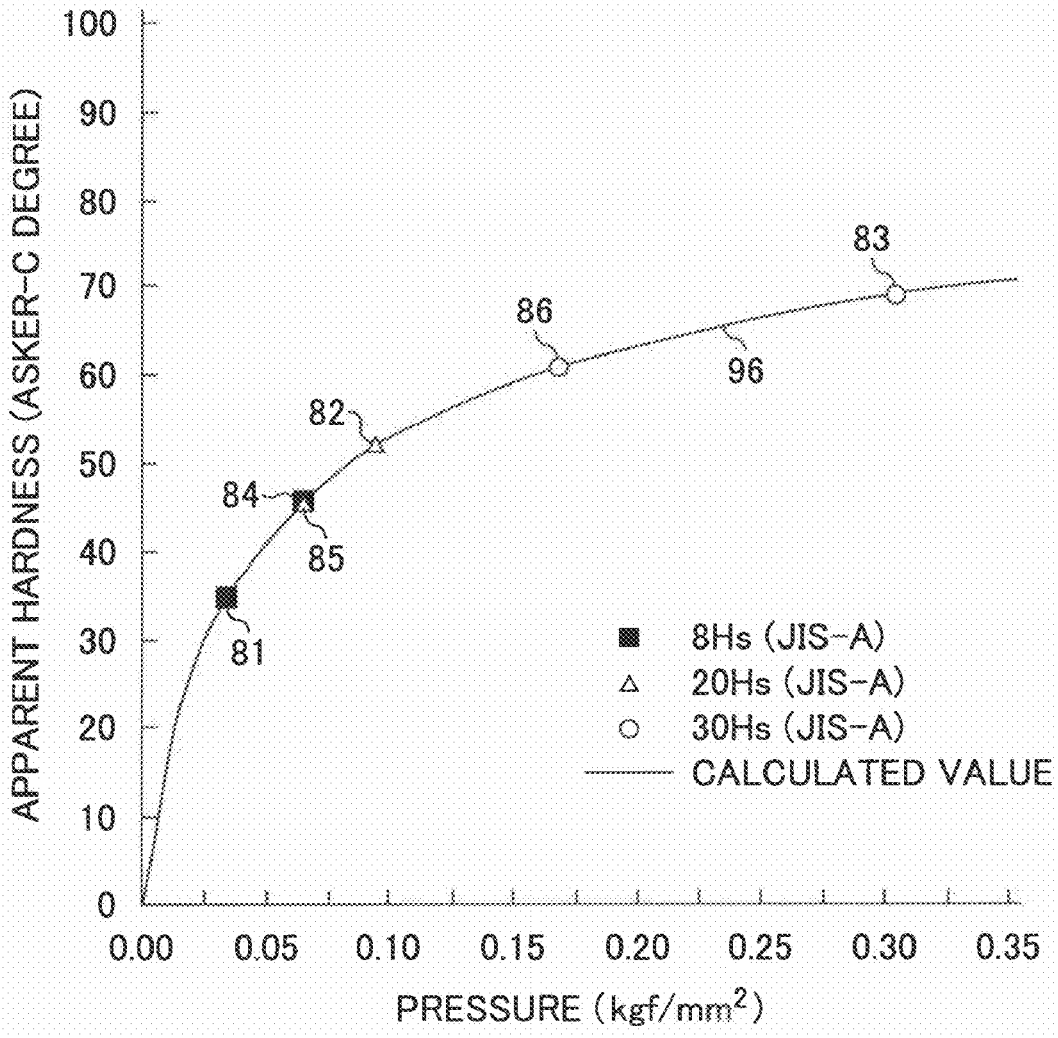
FIG. 4 is a graph of a relation between the apparent hardness (ASKER-C) and pressure.

FIG. 4 represents a relation between the hardness of the above rubbers and the pressure applied to the rubbers. The hardness is measured by using a spring-type hardness tester (ASKER-C type hardness meter manufactured by KOBUNSHI KEIKI CO., LTD.). The horizontal axis shown in FIG. 4 represents pressure (kgf/mm$^2$), and the vertical axis represents hardness (ASKER-C).

In the ASKER-C type hardness meter, a needle with a predetermined shape is pressed against the surface of a sample by a spring force to deform the sample. The ASKER-C type hardness meter indicates the hardness of the sample with a relative value in the range of 0 to 100 according to the depth representing how much the needle is pressed against the sample at the time when the resistance of the sample balances the force of the spring. The needle has a semi-spherical shape with a diameter $\phi$ of (5.08±0.02) mm, and protrudes by a distance of 2.54 mm toward a pressing surface (i.e., stroke length is 2.54 mm). An in-built coil spring serving as a load application unit is a linear spring. The load acting on the coil spring when the pointer of the meter indicates 0 degree is 55 gf while the coil spring load when the pointer indicates 100 degrees is (855±8) gf. The area in which the surface of the needle is in contact with the sample and the load value are calculated based on the scale of degrees, whereby the pressure applied to the sample can be calculated.

A curved line 96 shown in FIG. 4 represents the relation between the apparent hardness (ASKER-C) of the rubbers and the pressures applied to the rubbers. According to the calculation, the points 81, 82, and 83 shown in FIG. 3, at which the measured apparent hardness changes rapidly, and the test points 84, 85, and 86 shown in FIG. 3 are all on the curved line 96 shown in FIG. 4.

In the case of the hardness of 8 Hs (JIS-A), the apparent hardness of the rubber starts to change rapidly under the pressure of about 0.035 kgf/mm$^2$ (0.343 N/mm$^2$) at the point 81 at which the rubber thickness in the load application direction is 3 mm. In the case of the hardness of 20 Hs (JIS-A), the apparent hardness of the rubber starts to change rapidly under the pressure of about 0.065 kgf/mm$^2$ (0.637 N/mm$^2$) at the point 82 at which the rubber thickness in the load application direction is 2 mm. In the case of the hardness of 30 Hs (JIS-A), the apparent hardness of the rubber starts to change rapidly under the pressure of about 0.300 kgf/mm$^2$ (2.942 N/mm$^2$) at the point 83 at which the rubber thickness in the load application direction is 1.3 mm.

In the case of the hardness of 8 Hs (JIS-A), the rubber is applied with a pressure of about 0.065 kgf/mm$^2$ (0.637 N/mm$^2$) at the test point 84 at which the rubber thickness in the load application direction is 2 mm. In the case of the hardness of 20 Hs (JIS-A), the rubber is applied with a pressure of about 0.065 kgf/mm$^2$ (0.637 N/mm$^2$) at the test point 85 at which the rubber thickness in the load application is 4 mm. In the case of the hardness of 30 Hs (JIS-A), the rubber is applied with a pressure of about 0.170 kgf/mm$^2$ (1.667 N/mm$^2$) at the test point 86 at which the rubber thickness in the load application is 4 mm.

Figure 5:
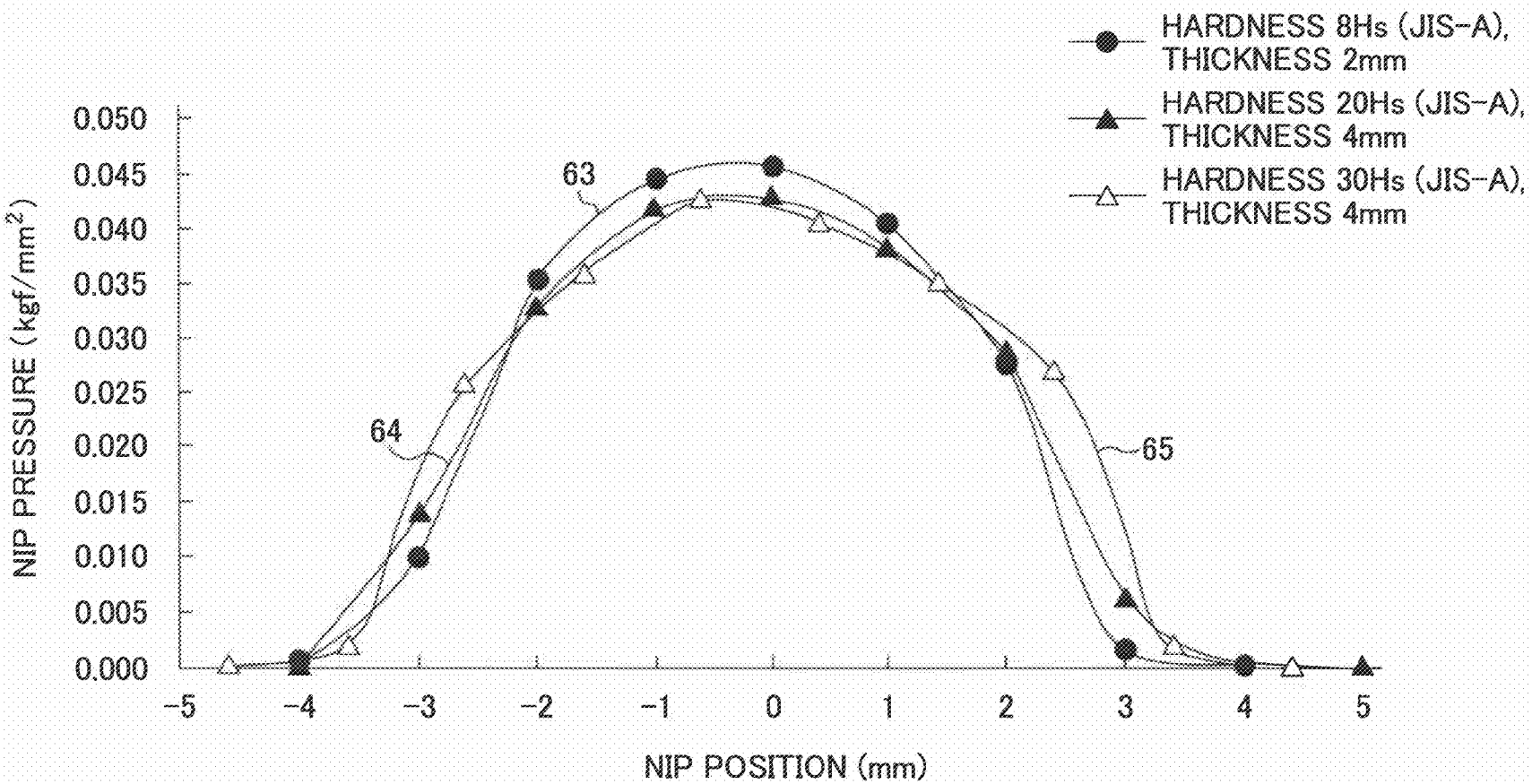
FIG. 5 is a graph of pressure distributions at a nip portion.

FIG. 5 is a graph of the pressure distributions at the nip portion obtained by performing fixing roller pressure tests. Specifically, FIG. 5 represents the pressure distributions at the nip portion formed when the heating-fixing roller 21 is applied with a load of 40 kgf by using three types of pressurizing members with different configurations. The heating-fixing roller 21 has an outer diameter of 27 mm, and includes an elastic layer having a thickness of 1.0 mm, a hardness of 8 Hs (JIS-A), and a permanent deformation of 4%. The heating-fixing roller 21 is made by SWCC Showa Cable Systems Co., Ltd. The horizontal axis shown in FIG. 5 represents the nip position in a direction in which a paper sheet is conveyed (hereinafter, "the paper sheet conveying direction") (mm), and the vertical axis represents the nip pressure (kgf/mm$^2$). On the horizontal axis, the positive numbers indicate locations upstream of a center of the nip portion, and the negative numbers indicate locations downstream of the center.

The following three types of rubber pads (each made by SWCC Showa Cable Systems Co., Ltd.) are used as the pressurizing member.

Rubber Pad (1): hardness: 8 Hs (JIS-A), permanent deformation: 4%, rubber thickness in the load application direction: 2 mm, rubber width in the paper sheet conveying direction: 4 mm, and rubber length in the axis direction (roller axis direction): 230 mm.

Rubber Pad (2): hardness: 20 Hs (JIS-A), permanent deformation: 4%, rubber thickness in the load application direction: 4 mm, rubber width in the paper sheet conveying direction: 6 mm, and rubber length in the axis direction: 230 mm.

Rubber Pad (3): hardness: 30 Hs (JIS-A), permanent deformation: 4%, rubber thickness in the load application direction: 4 mm, rubber width in the paper sheet conveying direction: 6.5 mm, and rubber length in the axis direction: 230 mm.

A curved line 63 shown in FIG. 5 represents the pressure distribution for the rubber pad (1), a curved line 64 represents the pressure distribution for the rubber pad (2), and a curved line 65 represents the pressure distribution for the rubber pad (3).

The rubber width in the paper sheet conveying direction of each rubber pad is adjusted to about 7 mm to 8 mm. The above rubber width is obtained by the following manner. That is, first, the rubber pad is set to have a width of 4 mm to 6.5 mm in the paper sheet conveying direction. Then, the rubber pad is pressurized by the fixing roller with the pressure of 40 kgf to stretch in the nip width direction. Consequently, each rubber pad is adjusted to about 7 mm to 8 mm thickness. The maximum nip pressure in the curved line 63 is larger than that in the curved line 65, which indicates that the pressure drops sharply at the ends of the nip portion in the curved line 63. If the permanent deformation of the elastic layer of the heating-fixing roller is large, the surface of the heating-fixing roller locally deforms, which may cause image deterioration such as uneven gloss of an image. The results of the fixing roller pressure tests indicate that the elastic layer of the heating-fixing roller having a permanent deformation equal to or more than 5% increases the amount of uneven gloss of an image. Hence, the permanent deformation is desirably equal to or less than 4%.

A large permanent deformation of the pressuring member may cause a temporal change of the nip shape, so that the fixing characteristics of toner to the paper sheet and the sheet releasability can be unstable. The results of the fixing roller pressure tests indicate that the pressurizing member having a permanent deformation equal to or more than 5% lowers the sheet releasability after the pressurizing roller was heated and idled for 100 hours or more. For this reason, it is desirable that the pressurizing member have a permanent deformation of equal to or less than 4%.

The width of the pressurizing member (in the paper sheet conveying direction) is preferably equal to or narrower than the width of the nip portion formed by brining the pressurizing member into pressure contact with the fixing member (heating-fixing roller 21 in the fixing device 20 shown in FIG. 2) with an infinite plate. The width of the pressurizing member is made appropriate. Hence, the elastic layer of the heating-fixing roller locally deforms, so that the paper sheet can be in an appropriate state at the nip exit from which the paper sheet exits the nip portion. This reduces the amount of shift of an image on the paper sheet and a load put on the paper sheet, and improves the sheet releasability.

Figure 6:
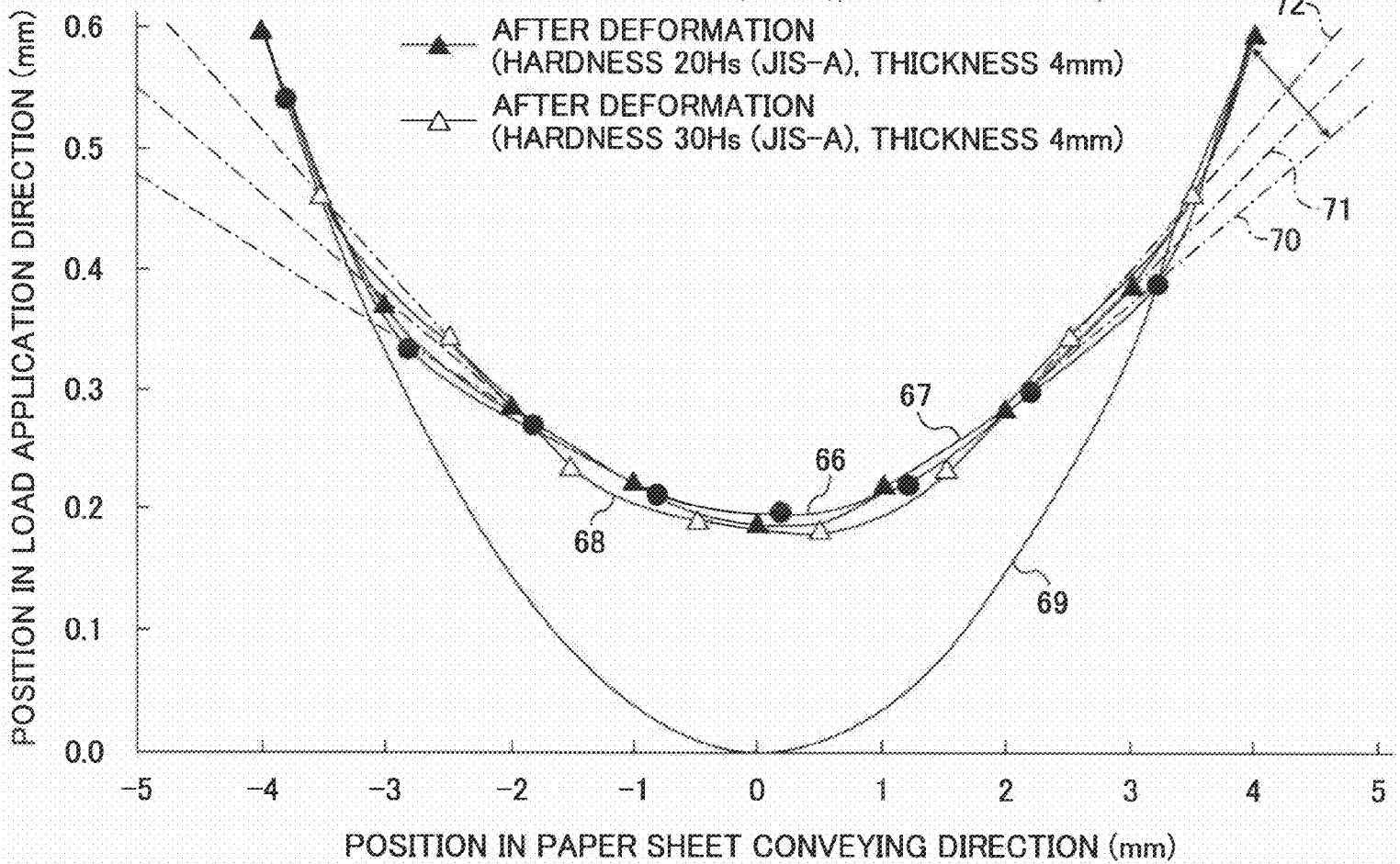
FIG. 6 is a graph of deformed shapes of an elastic layer of the heating-fixing roller and states of a paper sheet at a nip exit.

FIG. 6 is a graph of the results of calculating deformed shapes of the elastic layer of the heating-fixing roller from the actually measured pressure distributions, based on the measured results of the rubber physical properties shown in FIGS. 3 and 4. The calculation results were obtained without taking into account the deformations of the rubber in the paper sheet conveying direction and the pressurizing direction, however, they are sufficient for a comparative examination. The horizontal axis shown in FIG. 6 represents the position (mm) in the paper sheet conveying direction, and the vertical axis represents the position (mm) in the load application direction.

A curved line 69 shown in FIG. 6 represents the shape of the surface of the heating-fixing roller before the pressurizing member is pressed against the heating-fixing roller. Curved lines 66, 67, 68 each represent the shape of the surface of the elastic layer of the heating-fixing roller after the pressurizing member is pressed against the heating-fixing roller. Specifically, the curved line 66 represents the shape of the surface of the elastic layer of the heating-fixing roller after the pressurizing member having a hardness of 8 Hs (JIS-A) and a rubber thickness of 2 mm in the load application direction is pressed against the heating-fixing roller. The curved line 67 represents the shape of the surface of the elastic layer of the heating-fixing roller after the pressurizing member having a hardness of 20 Hs (JIS-A) and a rubber thickness of 4 mm in the load application direction is pressed against the heating-fixing roller. The curved line 68 represents the shape of the surface of the elastic layer of the heating-fixing roller after the pressurizing member having a hardness of 30 Hs (JIS-A) and a rubber thickness of 4 mm in the load application direction is pressed against the heating-fixing roller.

A curved line 70 shown in FIG. 6 simulates a state of the recording medium that exits from the nip portion along the nip shape represented by the curved line 66. A curved line 71 simulates a state of the recording medium that exits from the nip portion along the nip shape represented by the curved line 67. A curved line 72 simulates a state of the recording medium that exits from the nip portion along the nip shape represented by the curved line 68.

As shown in FIG. 6, a clearance between the surface of the recording medium and the surface of the heating-fixing roller downstream of the nip exit (intersection points of the curved line 69 with the straight lines 70 and 72) is large in the case of the curved line 70 compared to the curved line 72. The curved line 70 simulates the state of the recording medium after it exits from the nip portion, and it is considered that the larger the clearance is between the surface of the heating-fixing roller and the surface of the paper sheet after the exit of the nip portion, the easier the paper sheet is released from the surface of the heating-fixing roller.

Table 1 contains the results of the sheet releasability tests performed by using the fixing device 20 shown in FIG. 2. The sheet releasability tests were performed by changing only the configuration of the pressurizing member 32 under the same condition. The nip width was the same, and a cut sheet was used as the recording medium.

TABLE 1

| HARDNESS Hs(JIS-A) | THICKNESS mm | NIP WIDTH mm | APPARENT HARDNESS DEGREE (ASKER-C) | PRESSURE VALUE AT TEST POINT kgf/mm$^2$ | HARDNESS CHANGING POINT AT WHICH APPARENT HARDNESS STARTS TO CHANGE RAPIDLY kgf/mm$^2$ | RATIO BETWEEN WHOLE NIP WIDTH AND NIP WIDTH UNDER PRESSURE EQUAL TO OR MORE THAN PRESSURE AT HARDNESS CHANGING POINT % | SHEET RELEASABILITY |
|---|---|---|---|---|---|---|---|
| 8 | 2 | 8 | 46 | 0.065 | 0.034 | 43.75 | PREFERABLE |
| 20 | 4 | 8 | 46 | 0.065 | 0.095 | 0 | NOT PREFERABLE |
| 30 | 4 | 8 | 61 | 0.170 | 0.300 | 0 | NOT PREFERABLE |

In the sheet releasability tests, a full-color image was formed and fixed on an ordinary paper sheet with a basis weight of 55 g/cm$^2$. In these releasability tests, it was found that the pressurizing pad with a hardness of 8 Hs (JIS-A) and a rubber thickness of 2 mm in the load application direction leads to improved sheet releasability. Sufficient sheet releasability could not be obtained in other two cases. The sheet releasability improved because, as indicated by each line (each line simulating the state of the paper sheet) shown in FIG. 6, the elastic layer of the heating-fixing roller deforms appropriately when the member with a hardness of 8 Hs (JIS-A) and a thickness of 2 mm is used as the pressurizing member 32.

The pressurizing member with a hardness of 8 Hs (JIS-A) is applied with a pressure of 0.034 kgf/mm$^2$ (0.333 N/mm$^2$) at the point 81 where the apparent hardness starts to change rapidly with respect to the rubber thickness in the load application direction. In the sheet releasability test at the test point 84, a nip region in which a pressure equal to or more than 0.034 kgf/mm$^2$ is applied is about 3.5 mm, which occupies about 44% of the whole nip portion. As shown in FIG. 6, the apparent hardness of a rubber, which is thin in the load application direction, is larger than the actual hardness thereof in the nip region, so that it is considered that the elastic layer of the heating-fixing roller is deformed largely in the center region of the nip portion, which makes the paper sheet state appropriate. That is, the apparent hardness of the pressurizing member increases only at the center region of the nip portion, so that the elastic layer of the heating-fixing roller locally deforms and the paper sheet can be in an appropriate state at the nip exit. As a result, the sheet releasability improved.

The pressurizing member with a hardness of 20 Hs (JIS-A) is applied with a pressure of 0.095 kgf/mm$^2$ at the point 82 (see FIG. 4) where the apparent hardness starts to change rapidly. From Table 1, it can be seen that, at the test point 85, there is no nip region subjected to the pressure equal to or more than 0.095 kgf/mm$^2$ and there is no deformation in the center region of the nip portion of the elastic layer of the heating-fixing roller for allowing the paper sheet to be in an appropriate state at the nip exit. As the curved line 61 in FIG. 3 represents, the test point 85 at which the test was performed is on the right side (in the direction in which the rubber thickness increases and the apparent hardness decreases) of the point 82 in the graph. Therefore, it is found that the apparent hardness and the rubber thickness in the load application direction have a linear relation at the test point 85 unlike the test point 84 in the case of the hardness of 8 Hs (JIS-A).

The pressurizing member with a hardness of 30 Hs (JIS-A) is applied with a pressure of 0.300 kgf/mm$^2$ at the point 83 (see FIG. 4) where the apparent hardness starts to change rapidly. From Table 1, it can be seen that, at the test point 86, there is no nip region subjected to the pressure equal to or more than 0.300 kgf/mm$^2$ and there is no deformation in the center region of the nip portion of the elastic layer of the heating-fixing roller for allowing the paper sheet to be in an appropriate state at the nip exit. As indicated by the curved line 62 shown in FIG. 3, the test point 86 at which the test was performed is on the right side (in the direction in which the rubber thickness increases and the apparent hardness decreases) of the point 83 in the graph. In other words, the apparent hardness and the rubber thickness in the load application direction have a linear relation at the test point 86 unlike the test point 84 in the case of the hardness of 8 Hs (JIS-A).

Thus, it was confirmed that the deformed shape of the elastic layer of the heating-fixing roller will be in an appropriate state and there will be better sheet releasability only when the nip region, in which the pressure equal to or more than the pressure at the point at which the apparent hardness starts to change rapidly, is equal to or more that 40% of the whole nip portion.

Good releasability was obtained when the pressurizing member with a hardness of 8 Hs (JIS-A) was used. As is apparent from FIG. 4, the pressurizing member with a hardness of 8 Hs (JIS-A) used in the releasability tests (black square marks in FIG. 4) has an apparent hardness (ASKER-C) of equal to or less than 50 degrees when being applied with a pressure of 0 kgf/mm$^2$ to 0.075 kgf/mm$^2$. In other words, the use of a pressurizing member, which has an apparent hardness (ASKER-C) of equal to or less than 50 degrees when being applied with a pressure of 0 kgf/mm$^2$ to 0.075 kgf/mm$^2$ (0.735 N/mm$^2$), results in obtaining good releasability.

The larger the clearance is between the surface of the heating-fixing roller and the surface of the paper sheet after the exit from the nip portion, the easier the paper sheet is released from the surface of the heating-fixing roller. Thus, it is found that the outer diameter of the heating-fixing roller is a parameter for defining the clearance. The releasability test results indicated that the heating-fixing roller having an outer diameter equal to or more than 27 mm lowers the sheet releasability. Hence, it is desirable that the heating-fixing roller have an outer diameter equal to or less than 27 mm.

Furthermore, it is found that the thickness of the elastic layer of the heating-fixing roller is also a parameter for defining the clearance between the surface of the heating-fixing roller and the surface of the paper sheet. The releasability test results indicated that the rubber thickness equal to or less than 0.8 mm lowers the sheet releasability because a small thickness of the elastic layer leads to a small amount of deformation of the elastic layer, so that the paper sheet cannot be in an appropriate state at the nip exit. For this reason, it is desirable that the elastic layer have a thickness equal to or more than 0.8 mm.

Furthermore, it is found that the hardness of the elastic layer of the heating-fixing roller is also a parameter for defining the clearance. The releasability test results indicated that the hardness of the elastic layer equal to or more than 8 Hs (JIS-A) lowers the sheet releasability. The sheet releasability is lowered because a large hardness of the elastic layer leads to a small amount of the deformation of the elastic layer, so that the sheet cannot be in an appropriate state at the nip exit. For this reason, it is desirable that the elastic layer have a hardness equal to or less than 8 Hs (JIS-A).

Figure 7:
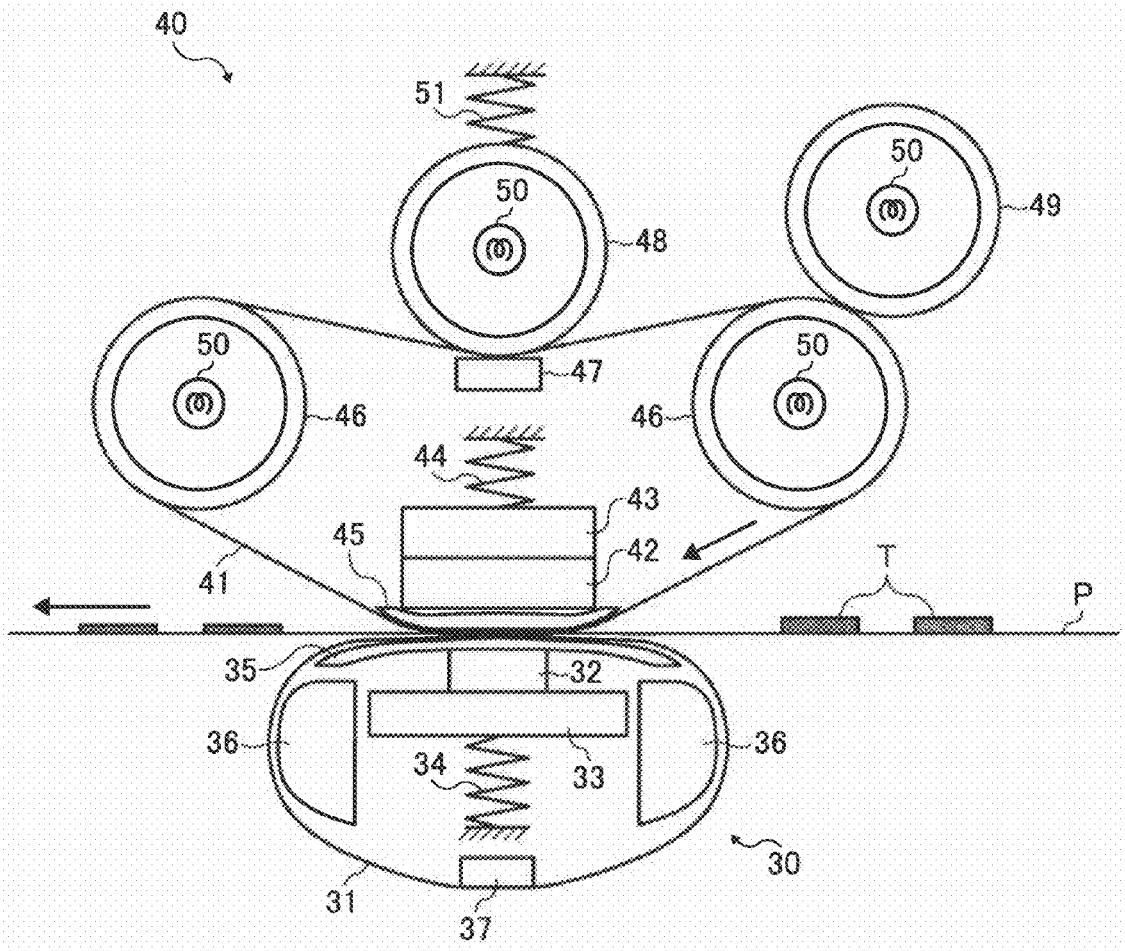
FIG. 7 is a schematic diagram of a fixing device according to a second embodiment of the present invention.

FIG. 7 is a schematic diagram of a fixing device 40 according to a second embodiment of the present invention. The structural elements same as those of the fixing device 20 shown in FIG. 2 are given the same reference numerals, and explanation thereof is omitted below. The fixing device 40 can be used instead of the fixing device 20 in the laser printer 100 shown in FIG. 1.

The fixing device 40 includes an endless fixing member 41 as an endless member. The pressurizing unit 30 is brought into pressure contact with the endless fixing member 41. The fixing device 40 includes, inside the loop of the endless fixing member 41, a pressurizing member 42, a supporting member 43 that supports the pressurizing member 42, a pressing spring 44 as a biasing unit that presses the pressurizing member 42 and the supporting member 43 against the pressurizing unit 30, a friction-reducing member 45 that is positioned between the endless fixing member 41 and the pressurizing member 42 and reduces friction therebetween, two heating rollers 46 that rotatably support the endless fixing member 41 while stretching the endless fixing member 41 and heat the endless fixing member 41, and an opposing member 47. A heat source 50 is built in each of the heating rollers 46.

A third heating roller 48 is arranged as a tension roller on the upper surface of the endless fixing member 41 and between the heating rollers 46. A fourth heating roller 49 is arranged on the right heating roller 46 shown in FIG. 7 with the endless fixing member 41 therebetween. The heat source 50 is built in each of the heating roller 48 and the heating roller 49. The third heating roller 48 is pressed by a pressing spring 51 serving as a biasing unit, brought into pressure contact with the opposing member 47 with the endless fixing member 41 therebetween, and gives a predetermined tension to the endless fixing member 41. The fourth heating roller 49 is brought into pressure contact with the right heating roller 46 with the endless fixing member 41 therebetween.

At least one of the heating rollers 46 in the loop is rotationally driven by a driving source (not shown), so that the endless fixing member 41 is driven to rotate in the clockwise direction. The third heating roller 48 and the fourth heating roller 49 rotate in response to the rotation of the endless fixing member 41. The pressurizing member 42 allows the endless fixing member 41 to form a predetermined nip portion, and includes an elastic member or an elastic layer. The pressurizing member 42 corresponds to the elastic layer 23 of the heating-fixing roller 21 in the first embodiment.

With this configuration, the endless fixing member 41 is heated from the back surface by the heating rollers 46, 46, and also is heated from the top surface by the third heating roller 48 and the fourth heating roller 49. The paper sheet P such as a transfer paper sheet with the unfixed toner image T thereon passes through the nip portion formed by bringing the endless fixing member 41 and the pressurizing unit 30 into pressure contact with each other. Whereby, the unfixed toner image T is fixed on the paper sheet P by the pressure at the fixing nip portion and the heat conducted from the endless fixing member 41 heated by the heating rollers 46, and the third and the fourth heating roller 48 and 49. If the endless fixing member 41 can get enough heat from the heating rollers 46 in the loop, the third and the fourth heating rollers 48 and 49 outside the loop may not be provided. In addition, the third heating roller 48 may be simply a tension roller without heating function.

The fixing device 40 in the second embodiment also includes the pressurizing unit 30 that is the same as that of the fixing device 20 in the first embodiment, and the endless fixing member 41 includes the pressurizing member 42 having the elastic member or the elastic layer at the nip portion. With this configuration, it is possible to provide a fixing device that is capable of preventing shift of an image on a paper sheet from occurring and a large load from being imposed on the paper sheet, and that is excellent in the sheet releasability, same as the fixing device 20 in the first embodiment.

The fixing device 40 in the second embodiment includes the endless fixing member 41 as the fixing member that is directly in contact with an unfixed toner image, so that the nip width and the deformation of the endless heating member at the nip exit can be adjusted with little change of the size of the fixing device. Therefore, the fixing device that is small in size and excellent in toner fixability can be realized. In the fixing device 40 including the endless fixing member 41, the width (length in the paper sheet conveying direction) of the pressurizing member 32 is required to be equal to or less than the width of the pressurizing member 42.

The embodiments of the present invention are explained above with reference to the drawings. However, the present invention is not limited to the embodiments. For example, any appropriate member can be used as the pressurizing member of the pressurizing unit so long as it satisfies the requirement described in the above embodiments. The heat source that heats the heating-fixing roller as a fixing member in the first embodiment can be arranged outside of the roller instead of arranging it inside the roller as shown in most of the diagrams. The induction heating system can be adapted as the heating system. The stretched endless fixing member 41 in the second embodiment can be changed in shape and the like arbitrary.

The image forming apparatus can be configured in other manner. For example, the intermediate transferring system can be adapted. Furthermore, the image forming apparatus can be a monochrome image forming apparatus or a color image forming apparatus. The image forming apparatus is not limited to a printer, and can be a copier, a facsimile, or a complex machine having many functions.

According to an aspect of the present invention, the amount of shift of an image on the paper sheet and a load imposed on the paper sheet can be reduced. As a result, sheet releasability improves.

According to another aspect of the present invention, it is possible to provide a fixing device excellent in sheet releasability at low cost.

According to still another aspect of the present invention, a nip shape can be prevented from temporarily changing.

According to still another aspect of the present invention, it is possible to easily correspond to a high speed printing. Furthermore, a nip width and the shape of a nip exit can be set easily while inhibiting the influence to the size of the fixing device.

According to still another aspect of the present invention, an endless fixing member can be stretched and heated with a simple configuration.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device comprising:

a fixing member with a deformable surface;

a heating unit configured to heat the fixing member;

a pressurizing unit that includes an endless member and a pressurizing member, the pressurizing member including an elastic layer that presses the endless member against the fixing member to bring the endless member into pressure contact with the fixing member, wherein a recording medium carrying an unfixed toner image passes through a nip portion formed between the fixing member and the endless member, so that the unfixed toner image is fixed on the recording medium by heat and pressure, and the elastic layer of the pressurizing member has a hardness equal to or less than 30 HS (JIS-A), the elastic layer of the pressurizing member has a rubber thickness equal to or less than 3 mm, and the nip portion is formed between only the pressurizing member and the fixing member.

2. The fixing device according to claim 1, wherein a length of the pressurizing member in a direction in which the recording medium is conveyed is equal to or less than a width of the nip portion that is formed when the fixing member is brought into pressure contact with an infinite plate.

3. The fixing device according to claim 1, wherein the elastic layer of the pressurizing member has an apparent hardness of 50 degrees (ASKER-C) when subjected to a pressure in a range of 0 $N/mm^2$ to 0.735 $N/mm^2$.

4. The fixing device according to claim 1, wherein the elastic layer of the pressurizing member has a hardness equal to or less than 8 Hs (JIS-A), and a rubber thickness equal to or less than 2 mm in a load application direction.

5. The fixing device according to claim 1, wherein the elastic layer of the pressurizing member has a permanent deformation equal to or less than 4%.

6. The fixing device according to claim 5, wherein the elastic layer of the pressurizing member has a rubber thickness equal to or less than 2 mm in the load application direction.

7. The fixing device according to claim 1, wherein the fixing member is a fixing roller including a second elastic layer, and the heating unit is arranged inside the fixing roller.

8. The fixing device according to claim 7, wherein the fixing roller has a diameter equal to or less than 27 mm, and the second elastic layer has a hardness equal to or less than 8 Hs (JIS-A) and a rubber thickness equal to or more than 0.8 mm.

9. The fixing device according to claim 7, wherein the second elastic layer has a permanent deformation equal to or less than 4%.

10. The fixing device according to claim 1, further comprising an elastic member, wherein the fixing member is an endless fixing member, and the elastic member allows the endless fixing member to be brought into pressure contact with the endless member.

11. The fixing device according to claim 10, further comprising a plurality of heating rollers each incorporating a heat source, wherein the fixing member is stretched around the heating rollers.

12. The fixing device according to claim 1, further comprising a friction-reducing member that is positioned between the endless member and the pressurizing member to reduce friction between the endless member and the pressurizing member.

13. The fixing device according to claim 1, further comprising an elastic member and a friction-reducing member, wherein the elastic member allows the fixing member to be brought into pressure contact with the endless member, and the friction-reducing member is positioned between the fixing member and the elastic member to reduce friction between the fixing member and the elastic member.

14. An image forming apparatus comprising:

a fixing member with a deformable surface;

a heating unit configured to heat the fixing member;

a pressurizing unit that includes an endless member and a pressurizing member, the pressurizing member including an elastic layer that presses the endless member against the fixing member to bring the endless member into pressure contact with the fixing member, wherein a recording medium carrying an unfixed toner image passes through a nip portion formed between the fixing member and the endless member, so that the unfixed toner image is fixed on the recording medium by heat and pressure, and the elastic layer of the pressurizing member has a hardness equal to or less than 30 HS (JIS-A).

the elastic layer of the pressurizing member has a rubber thickness equal to or less than 3 mm. and the nip portion is formed between only the pressurizing member and the fixing member.

15. A fixing device comprising:

a fixing member with a deformable surface;

a heating unit configured to heat the fixing member;

a pressurizing unit that includes an endless member and a pressurizing member, the pressurizing member including an elastic layer that presses the endless member against the fixing member to bring the endless member into pressure contact with the fixing member, wherein a recording medium carrying an unfixed toner image passes through a nip portion formed between the fixing member and the endless member, so that the unfixed toner image is fixed on the recording medium by heat and pressure, and the elastic layer of the pressurizing member has an apparent hardness of 50 degrees (ASKER-C) when subjected to a pressure in a range of 0 $N/mm^2$ to 0.735 $N/mm^2$.

16. An image forming apparatus comprising:

a fixing member with a deformable surface;

a heating unit configured to heat the fixing member;

a pressurizing unit that includes an endless member and a pressurizing member, the pressurizing member including an elastic layer that presses the endless member against the fixing member to bring the endless member into pressure contact with the fixing member, wherein a recording medium carrying an unfixed toner image passes through a nip portion formed between the fixing member and the endless member, so that the unfixed toner image is fixed on the recording medium by heat and pressure, and the elastic layer of the pressurizing member has an apparent hardness of 50 degrees (ASKER-C) when subjected to a pressure in a range of 0 $N/mm^2$ to 0.735 $N/mm^2$.

17. The image forming apparatus according to claim 16, wherein a length of the pressurizing member in a direction in which the recording medium is conveyed is equal to or less than a width of the nip portion that is formed when the fixing member is brought into pressure contact with an infinite plate.

18. The image forming apparatus according to claim 16, wherein the elastic layer of the pressurizing member has a hardness equal to or less than 8 Hs (JIS-A), and a rubber thickness equal to or less than 2 mm in a load application direction.

19. The image forming apparatus according to claim 16, wherein the elastic layer of the pressurizing member has a permanent deformation equal to or less than 4%.

20. The image forming apparatus according to claim 19, wherein the elastic layer of the pressurizing member has a rubber thickness equal to or less than 2 mm in the load application direction.

21. The image forming apparatus according to claim 16, wherein the fixing member is a fixing roller including a second elastic layer, and the heating unit is arranged inside the fixing roller.

22. The image forming apparatus according to claim 21, wherein the fixing roller has a diameter equal to or less than 27 mm, and the second elastic layer has a hardness equal to or less than 8 Hs (JIS-A) and a rubber thickness equal to or more than 0.8 mm.

23. The image forming apparatus according to claim 21, wherein the second elastic layer has a permanent deformation equal to or less than 4%.

24. The image forming apparatus according to claim 16, further comprising an elastic member, wherein the fixing member is an endless fixing member, and the elastic member allows the endless fixing member to be brought into pressure contact with the endless member.

25. The image forming apparatus according to claim 24, further comprising a plurality of heating rollers each incorporating a heat source, wherein the fixing member is stretched around the heating rollers.

26. The image forming apparatus according to claim 16, further comprising a friction-reducing member that is positioned between the endless member and the pressurizing member to reduce friction between the endless member and the pressurizing member.

27. The image forming apparatus according to claim 16, further comprising an elastic member and a friction-reducing member, wherein the elastic member allows the fixing member to be brought into pressure contact with the endless member, and the friction-reducing member is positioned between the fixing member and the elastic member to reduce friction between the fixing member and the elastic member.

* * * * *